United States Patent [19]

Sawada et al.

[11] Patent Number: 4,775,767

[45] Date of Patent: Oct. 4, 1988

[54] ILLUMINATIVE SWITCH ASSEMBLY

[75] Inventors: Kenji Sawada; Shinji Yanai; Akinori Ito; Osamu Ishiguro, all of Furukawa, Japan

[73] Assignee: Alps Electric Co., Ltd., Japan

[21] Appl. No.: 77,980

[22] Filed: Jul. 27, 1987

Related U.S. Application Data

[63] Continuation of Ser. No. 860,631, May 7, 1986, abandoned.

[30] Foreign Application Priority Data

May 7, 1985 [JP] Japan ..... 60-96986

[51] Int. Cl.[4] ..... H01H 9/00

[52] U.S. Cl. ..... 200/310

[58] Field of Search ..... 200/310-312, 200/313, 314, 315, 317; 362/23, 26, 95

[56] References Cited

U.S. PATENT DOCUMENTS

| | | | |
|---|---|---|---|
| 2,410,519 | 11/1946 | Opalek | 200/310 |
| 2,580,056 | 12/1951 | Wheeler, Jr. | 200/317 |
| 2,648,305 | 8/1953 | Appleman | 200/317 |
| 3,320,389 | 5/1967 | Arlauskas | 200/302.3 |
| 4,135,073 | 1/1979 | Kobayashi | 200/315 |

FOREIGN PATENT DOCUMENTS

| | | | |
|---|---|---|---|
| 2008914 | 5/1969 | France | 200/315 |

*Primary Examiner*—Henry J. Recla
*Assistant Examiner*—Linda J. Sholl
*Attorney, Agent, or Firm*—Guy W. Shoup; Paul J. Winters

[57] ABSTRACT

A switch assembly has a holder which supports a switch and a light source inside. The holder is formed with a concavity recessed down from a central portion of the upper surface, and the cavity is formed with a hole at the bottom to expose a lever or knob of the switch. The concavity has a light hole communicating the light source to guide a light beam to the lever or knob.

2 Claims, 1 Drawing Sheet

ILLUMINATIVE SWITCH ASSEMBLY

This is a continuation application from application Ser. No. 860,631 filed May 7, 1986, now abandoned.

FIELD OF THE INVENTION

This invention relates to a switch assembly for a switch particularly of power-driven windows of a car.

BACKGROUND OF THE INVENTION

Heretofore, there are various kinds of power-window switches such as lever switches or seesaw switches. One of recently preferred types from a viewpoint of design is a switch having a lever placed down a concavity or offset portion in a car. Such an offset location is usually out of the ambient light. Since the prior art arrangement has no illuminator unique to the switch, it is often difficult for a user to acknowledge at a glance the position of the switch lever or knob particularly at night.

OBJECT OF THE INVENTION

It is therefore an object of the invention to provide a switch holding assembly which clearly indicates the position of a knob or lever of the switch and hence permits a driver to keep his eyes on the road.

SUMMARY OF THE INVENTION

According to the present invention, there is provided a switch assembly comprising:

a holder having a concavity recessed down from one surface thereof, a through hole passing therethrough and opening at said concavity, and a light path opening at said concavity;

a switch received in said through hole and having a manually-operated lever or knob projecting into said concavity; and a light source received in said light path for emitting a light beam through said light path to illuminate said lever or knob.

DETAILED DESCRIPTION

Figure 1:
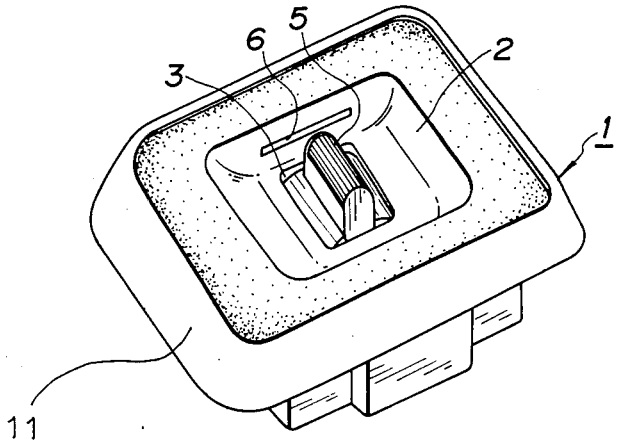
FIG. 1 is a perspective view of an illuminative switch holding assembly embodying the invention.
Figure 2:
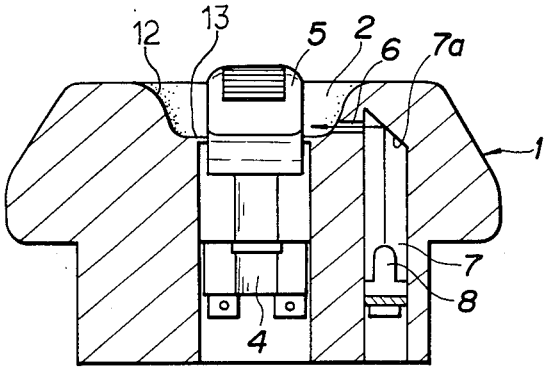
FIG. 2 is a cross-sectional view of the assembly of FIG. 1.

The invention will be better understood from the description given below, referring to a preferred embodiment illustrated in the drawings.

A switch holder generally designated at 1 includes a holder 11 which is formed at the center of an upper surface thereof with a concavity 2 which occupies a considerable area of the upper surface. The concavity 2 is defined by angled vertical walls 12 which are joined to a horizontal bottom face 13, defining a round or arcuate corner therebetween. The bottom 13 of the concavity 2 is formed at the center thereof with a through hole 3 which opens at the bottom of the holder 11. The through hole 3 accepts therein a switch 4 having a knob 5 which extends and projects into the concavity 2. One of the vertical walls 12 of the concavity 2 has an opening of an illumination slit 6 elongated rectangularly with respect to the length direction of the lever knob 5 and extending substantially along the bottom 13. The illumination slit 6 communicates with an upper portion of a light path 7 which extends to and opens at the bottom of the holder 11, parallel with and apart from the through hole 3. The light path 7 has an upper surface *7a* having 45 degrees inclination with respect to the depth direction of the illumination slit 6 to reflect into the slit 6 a beam of light coming from a light source lamp 8 located at a lower position of the light path 7.

With this arrangement, when the lamp 8 is lit, the beam of light hits the upper limit *7a* of the light path 7 and is reflected thereby into the illumination slit 6 to light the concavity 2. This illumination is moderate or modest because the light beam is once reflected. Also, since the corner around the bottom 13 of the concavity 2 is round or arcuate, the moderate illumination gives an impression as if the entire concavity 2 were embossed on the holder 11.

The concavity 2, although illustrated as having a rectangular upper margin, may be in a circular, oval or any other configuration.

As described, the invention arrangement gives a user a clear indication of the location of a switch lever in a car, with a moderate illumination which never distracts a driver's attention from the road.

The embodiments of the invention in which an exclusive property or privilege is claimed are defined as follows:

1. An illuminative switch assembly comprising:

a switch holder having a lower body, an upper surface disposed above said lower body, and a concavity recessed in a central part of the upper surface, said concavity being defined by downwardly extending side walls surrounding a horizontal bottom wall, said bottom wall having a central opening therein leading downward into a hole extending into the lower body of the switch holder beneath said upper surface;

a switch mounted in said hole having a manually-operable knob extending upwardly through said central opening in said bottom wall into the space of said concavity; and a slit formed in one side wall of said concavity extending horizontally along said bottom wall, a light passage formed in the body of said switch holder behind said one side wall and extending downwardly into said lower body, a reflection surface at an upper end of said light passage in communication with said slit in said side wall, and a light source at a lower end of said light passage for transmitting light through said light passage to be reflected from said reflecting surface through said slit into the space of said concavity, wherein said side walls lead into curved corners with said bottom wall, and said slit is formed horizontally along said bottom wall in one curved corner into which one side wall leads such that light is transmitted horizontally therethrough parallel to said bottom wall and is reflected from the other curved corners and indirectly illuminates said knob to give the visual impression of said knob floating in said illuminated concavity.

2. An illuminative switch assembly as claimed in claim 1, wherein said knob is a lever rockable along one horizontal direction, and said slit extends in said horizontal direction in said one side wall on one side of said lever.

* * * * *

UNITED STATES PATENT AND TRADEMARK OFFICE

CERTIFICATE OF CORRECTION

PATENT NO. : 4,775,767

DATED : October 4, 1988

INVENTOR(S) : Kenji Sawada; Shinji Yanai; Akinori Ito; Osamu Ishiguro

It is certified that error appears in the above-identified patent and that said Letters Patent is hereby corrected as shown below:

Title page:

In the Abstract, line 4, change "cavity" to --concavity--.

Signed and Sealed this

Twenty-first Day of March, 1989

*Attest:*

DONALD J. QUIGG

*Attesting Officer*

*Commissioner of Patents and Trademarks*